United States Patent [19]

Hanamoto et al.

[11] 4,439,143

[45] Mar. 27, 1984

[54] HEAT ROLLER FIXING DEVICE

[75] Inventors: Hiroyuki Hanamoto; Yoshihiro Horie, both of Toyokawa, Japan

[73] Assignee: Minolta Camera Kabushiki Kaisha, Osaka, Japan

[21] Appl. No.: 352,251

[22] Filed: Feb. 25, 1982

[30] Foreign Application Priority Data

Mar. 12, 1981 [JP] Japan ..... 56-36172

[51] Int. Cl.[3] ..... F27B 1/26; F27B 9/28

[52] U.S. Cl. ..... 432/36; 432/60

[58] Field of Search ..... 432/36, 51, 60

[56] References Cited

U.S. PATENT DOCUMENTS 4,045,165 8/1977 Nakajima et al. ..... 432/60

4,276,603 6/1981 Beck et al. ..... 432/36

4,319,874 3/1982 Sawano ..... 432/60

*Primary Examiner*—John J. Camby

*Attorney, Agent, or Firm*—Wenderoth, Lind & Ponack

[57] ABSTRACT

A heat roller fixing device comprising a changeover arrangement to be selectively changed over in accordance with thickness of a copy paper, and a control circuit for causing a heating roller and a pressure roller in pressure contact with the heating roller to rotate when the changeover arrangement has been changed over to a thick paper and for stopping the rotation of the heating roller and pressure roller when the surface of the heating roller has reached a predetermined temperature.

3 Claims, 10 Drawing Figures

HEAT ROLLER FIXING DEVICE

BACKGROUND OF THE INVENTION

The present invention generally relates to an electrophotographic copying apparatus and more particularly, to a heat roller fixing device for use in an electrophotographic copying apparatus, in which a toner image transferred onto a transfer material such as copy paper is fused to be fixed on the copy paper.

Generally, in conventional heat roller fixing devices of the above-described type, it has been so arranged that a heating roller having a heating means therein, and a pressure roller in pressure contact with the heating roller are provided for passing therebetween copy paper bearing a toner image thereon so as to fix such toner image onto the copy paper, while the surface of the heating roller being maintained to a predetermined temperature so that proper fixing of the toner image can be achieved. In the known fixing devices, it has been further arranged so that a thick paper copying switch is separately provided for copying on a thick copy paper larger in thickness than an ordinary copy paper (plain paper), e.g. a postal card or the like and, by turning on the switch, a surface temperature of the heating roller is set slightly higher than that for the plain paper. The switch is required to be provided because the temperature set for the plain paper is insufficient for fusion fixing of the toner image on the thick paper which absorbs a larger quantity of heat than the plain paper.

It is to be noted here that the plain paper is distinguished from the thick paper by the weight, and more specifically, in the case of a process speed of 130 mm/sec., the plain paper ranges from 58 to 89 g/m$^2$ at a set temperature of 153° C. while the thick paper is in the range of between 90 and 157 g/m$^2$ at a set temperature of 163° C.

In the conventional fixing devices, there has been such an inconvenience that, since a temperature is required to be set for the thick paper separately from that for the plain paper as described above, an additional circuit for setting the temperature is required to be provided and thus, durability of the heating roller is extremely deteriorated. Namely, when the surface temperature of the heating roller is increased, temperature of a core metal thereof rises considerably and thus, problems arise as to deterioration of bonding strength of adhesives provided between the surface material of the heating roller and the core metal thereof, etc.

Furthermore, the known fixing devices have such a disadvantage that, since a temperature detecting element is required to be provided for accurately measuring a wide range of temperature, cost of the fixing devices is undesirably raised together with provision of the above-described additional temperature setting circuit.

Moreover, the conventional fixing devices are defective in that, since the heating roller is maintained at high temperatures for a predetermined time period after the thick paper copying switch has been turned off, undesirable offset phenomenon on the surface of the heating roller, i.e. so-called high temperature offset phenomenon takes place when copying on the plain paper is performed immediately after the thick paper copying switch has been turned off, so that the predetermined waiting time is undesirably required to be provided before the copying on the plain paper is performed, thus resulting in an inconvenience in the operation of the device.

Meanwhile, in the known fixing devices of a type in which an offset preventing liquid such as a silicone oil is applied to the surface of a heating roller as disclosed in U.S. Pat. No. 4,045,165, there has been such disadvantages that consumption of the silicone oil increases in proportion to volatilization thereof due to the high set temperature and further, temperature in the copying apparatus is also raised by the high set temperature, so that various portions such as a photosensitive member or photoreceptor, etc. are adversely affected.

SUMMARY OF THE INVENTION

Accordingly, an essential object of the present invention is to provide an improved heat roller fixing device which enables proper fixing of a toner image on both a plain paper and a thick paper at a single set temperature of a heating roller, with substantial elimination of the disadvantages inherent in conventional heat roller fixing devices of this kind.

Another important object of the present invention is to provide an improved heat roller fixing device of the above-described type which eliminates the need for provision of an additional temperature setting circuit and an additional temperature detecting element measurable over a wide range of temperature and therefore, can be manufactured at low cost.

Still another object of the present invention is to provide an improved heat roller fixing device of the above-described type in which fixing of the toner image on the plain paper can be accomplished without any waiting time, even immediately after copying onto the thick paper.

A still further object of the present invention is to provide an improved heat roller fixing device of the above-described type which is simple in structure, highly reliable in actual use, and can be readily incorporated into copying apparatuses and the like at low cost.

In accomplishing these and other objects according to one preferred embodiment of the present invention, there is provided a heat roller fixing device comprising a changeover means to be selectively changed over in accordance with thickness of a copy paper, and a control circuit for causing a heating roller and a pressure roller in pressure contact with the heating roller, to rotate when the changeover means has been changed over to a thick paper and for stopping the rotation of the heating roller and press roller when the surface of the heating roller has reached a predetermined temperature.

Namely, in accordance with the present invention, when copying on the thick paper is performed, the heating roller and pressure roller are rotated so as to preheat the pressure roller through heat transmission from the heating roller to the pressure roller so that the thick paper may be heated efficiently, whereby non-uniform fixing of a toner image onto the thick paper is advantageously eliminated.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts and portions are designated by like reference numerals and symbols throughout several views of the accompanying drawings.

DETAILED DESCRIPTION OF THE INVENTION

Figure 1:
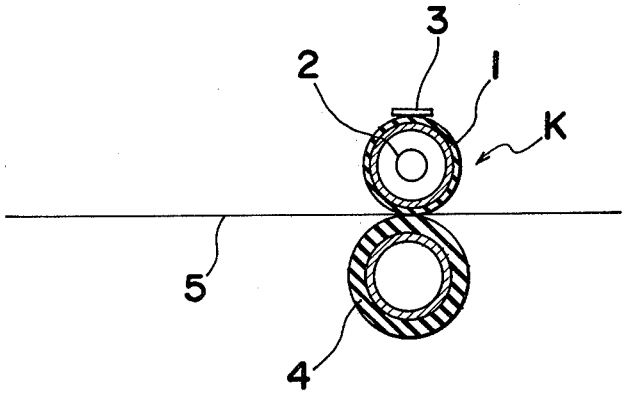
FIG. 1 is a cross-sectional view of a heat roller fixing device according to one preferred embodiment of the present invention.

Referring now to the drawings, there is shown in FIG. 1, a heat roller fixing device K according to one preferred embodiment of the present invention, which generally includes a heating roller 1 and a pressure roller 4. The heating roller 1 has a heater 2 disposed, as a temperature detecting means, at a central portion thereof and is provided with a thermistor 3 disposed at an upper portion thereof. The pressure roller 4 is brought into pressure contact with the heating roller 1 by a spring means (not shown) so that the pressure roller 4 may be driven to be rotated by rotational drive of the heating roller 1. It is so arranged that a copy paper 5 bearing a toner image on one face thereof is passed through between the heating roller 1 and the pressure roller 4, with the toner image bearing face being directed upwards so that the toner image may be fused for fixing thereof onto the copy paper 5.

It should be noted here that U.S. Pat. No. 4,045,165 described earlier discloses a similar contact heat fixing device which comprises a driving heating roller having a heating means, disposed in the interior thereof and a surface coated with an offset preventing material, a pressure roller which is rotated in intimate contact under pressure with the heating roller, a vessel for containing therein an offset preventing liquid and a feed mechanism for supplying the offset preventing liquid to the heating roller from the vessel, but has disadvantages as described previously.

Referring back to FIG. 1, in the heat roller fixing device of the present invention, surface temperature of the heating roller 1 is detected by the thermistor 3 and is maintained at, for example, 156° C. through ON-OFF control of the heater 2.

Figure 2:
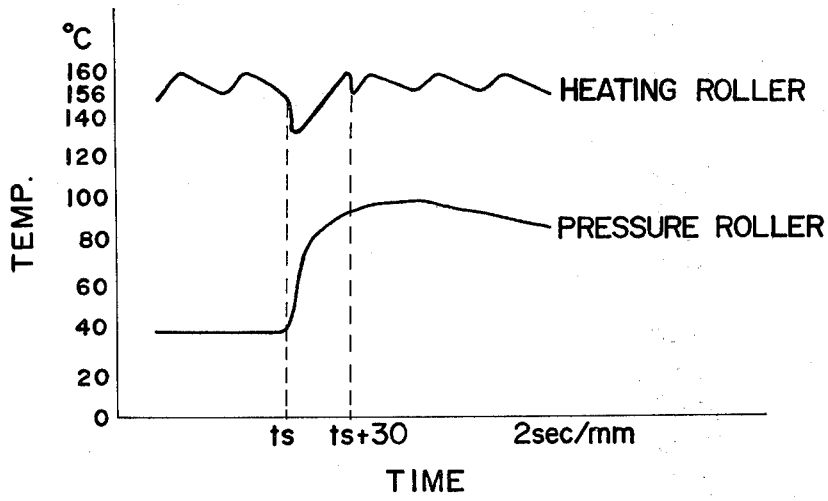
FIG. 2 is a graph showing variations of surface temperatures of a heating roller and a pressure roller employed in the heat roller fixing device of FIG. 1 with respect to time.

Surface temperatures of the heating roller 1 and pressure roller 4 vary with lapse of time as shown in FIG. 2 when driven for rotation thereof. Namely, when the heating roller 1 and pressure roller 4 are rotated in response to starting of a main motor 7, heat of the heating roller is absorbed by the pressure roller 4, so that the surface temperature of the heating roller 1 drops sharply, while the surface temperature of the pressure roller 4 rises abruptly from about 40° C. corresponding to intermittent copying operations. After the lapse of about 30 sec., the surface temperature of the heating roller 1 is restored to the set temperature of 156° C., while the surface temperature of the pressure roller 4 reaches an equilibrium temperature of about 80° C.

It should be noted that, since the present invention utilizes the temperature states of the heating roller 1 and pressure roller 4 after the lapse of 30 sec., it is so arranged that a thick paper copying switch provided on an operating panel, etc. is turned on in the case of copying on a thick paper, and a copying operation is prohibited for 30 sec. after turning on of the thick paper copying switch, while the heating roller 1 and pressure roller 4 are rotated so as to preheat the pressure roller 4 If the surface temperature of the heating roller 1 has not yet reached the set temperature of 156° C. after the lapse of 30 sec., the heating roller 1 and pressure roller 4 are further rotated. When the surface temperature of the heating roller has finally reached the set temperature of the heating roller has finally reached the set temperature of 156° C., the rotation of the heating roller 1 and pressure roller 4 is stopped, while the prohibition of the copying operation is nullified.

It is so arranged that the thick paper copying switch is not actuated during a duration from turning on of a power source to completion of the warming up, during waiting period for copying on the thick paper, and during a copying operation.

Therefore, according to this embodiment, since upon lapse of the waiting time of 30 sec., the surface temperature of the heating roller 1 is restored to the set temperature of 156° C. while the surface temperature of the pressure roller 4 rises from the previous 40° C. to about 80° C., heat due to the temperature rise of 40° C. is applied from the other face opposite to the toner image bearing face of the thick paper so as to improve fixing property of the toner image on the thick paper.

The waiting time of 30 sec. is provided in consideration of response time for temperature detection of the thermistor 3. If the thermistor 3 has a short response time, the compulsory waiting time of 30 sec. can be reduced. For example, waiting is completed by detecting that the surface temperature of the heating roller 1 which once dropped, has reached the set temperature.

Figure 3:
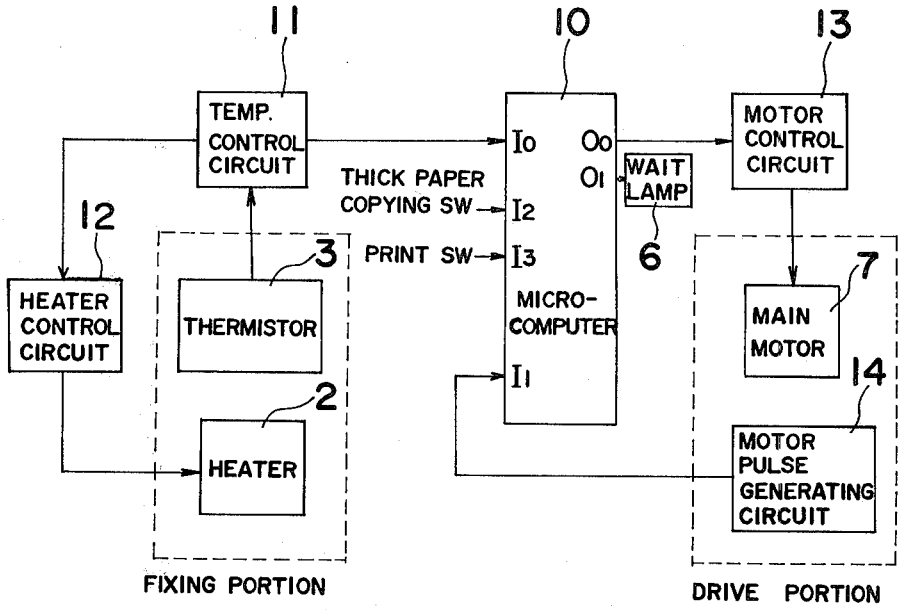
FIG. 3 is a block diagram of a control circuit employed in the heat roller fixing device of FIG. 1.

The above-described operations are controlled by a control circuit including a microcomputer 10 as shown in FIG. 3.

Figure 4:
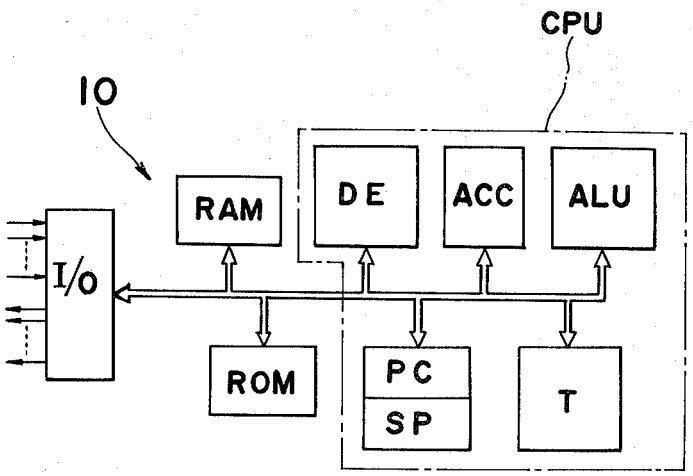
FIG. 4 is a schematic block diagram of a microcomputer employed in the control circuit of FIG. 3, FIGS. 5(*a*) to 5(*c*) are flow charts showing processing sequences of operational control of a copying apparatus by the microcomputer of FIG. 4, FIGS. 6(*a*) and 6(*b*) are flow charts similar to FIGS. 5(*a*) and 5(*c*), respectively, particularly showing a modification thereof.

The microcomputer 10 will now be described with reference to FIG. 4. As shown in FIG. 4, the microcomputer 10 comprises a central processing unit CPU, including an arithmetic logic unit ALU, an accumulator ACC, a decoder DE, a program counter PC, a stack pointer SP and an LSI circuit board having a random access memory RAM and a read-only memory ROM which are fabricated into one or separate chips, and is adapted to receive input signals from external electric circuits through an input-output interface I/0 and to generate a control signal to external electric circuits. In this embodiment, NECμCOM43 (name used in trade and manufactured by Nippon Electric Company, Limited, Japan) is employed as chips of the microcomputer 10.

The control signal is used to count the number of reference pulses generated mainly by a timer T and to generate operation control signals to be applied to the various components of the copying apparatus in accordance with a program stored in the read-only memory ROM according to the number of the reference pulses counted thereby, the details thereof being, however, omitted for the sake of brevity, since they do not constitute a subject matter of the present invention. It is to be noted that the central processing unit CPU of the microcomputer 10 is to be understood as further including, in addition to the components shown in FIG. 4, a flag flip-flop and various working registers with or without its peripheral LSI elements added thereto.

Referring back to FIG. 3, the surface temperature of the heating roller 1 is detected by the thermistor 3. Then, if the surface temperature of the heating roller 1 has not reached the set temperature, a heater control circuit 12 is actuated by a temperature control circuit 11 so as to turn on the heater 2. When the surface temperature of the heating roller 1 has reached the set temperature, the heater 2 is turned off.

Meanwhile, a signal from the temperature control circuit 11 is supplied to the microcomputer 10 as an input $I_o$, and the input $I_o$ is subjected to operational processing for control thereof together with an input $I_2$ from the thick paper copying switch and an input $I_3$ from the print switch. It is so arranged that, during the warming up after turning on of the power source, a wait lamp 6 is turned on by the input $I_o$ from the temperature control circuit 11, while the input $I_2$ from the thick paper copying switch and the input $I_3$ from the print switch are not received by the microcomputer 10.

When the input $I_2$ from the thick paper copying switch has been received by the microcomputer 10, a motor control circuit 13 is actuated so as to start the main motor 7 so that the heating roller 1 and pressure roller 4 may be driven to rotate. Since heat of the heating roller 1 is absorbed by the pressure roller 4 during the rotation of the heating roller 1 and pressure roller 4, the surface temperature of the heating roller 1 drops below the set temperature as described above. Accordingly, the main motor 7 is kept rotating until the surface temperature of the heating roller 1 is restored to the set temperature, namely until the input $I_o$ of a set temperature detecting signal is supplied to the microcomputer 10 from the temperature control circuit 11.

It should be noted that electric power is applied to the main motor 7 at least for 30 sec. and thus, the heating roller 1 and pressure roller 4 are forcibly driven to rotate.

Then, the motor control circuit is actuated by the input $I_3$ from the print switch so as to start an ordinary copying operation.

Meanwhile, in the control circuit shown in FIG. 3, it is so arranged that a motor pulse generating circuit 14 is actuated by drive of the main motor 7 so as to supply an input $I_1$ of the motor pulse signal to the microcomputer 10 so that one routine of operations of the microcomputer 10 may be ensured.

Hereinbelow, one example of processing sequences by the control circuit in the case where the control circuit is applied to a copying apparatus will be described with reference to flow charts shown in FIGS. 5(*a*) to 5(*c*). It is to be noted that the flow charts deal with only sequences related to the present invention, and other sequences not related to the present invention are abbreviated for brevity.

Figure 5:
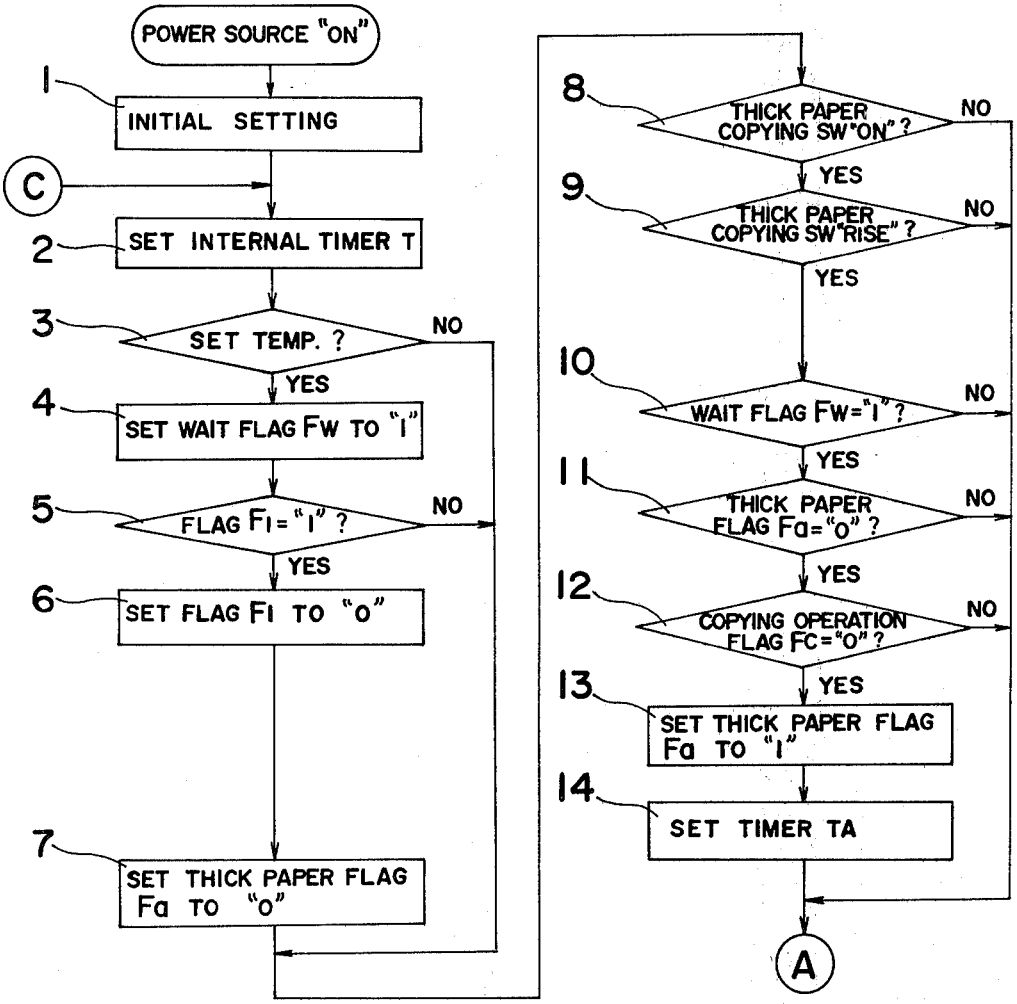
Figure 5:
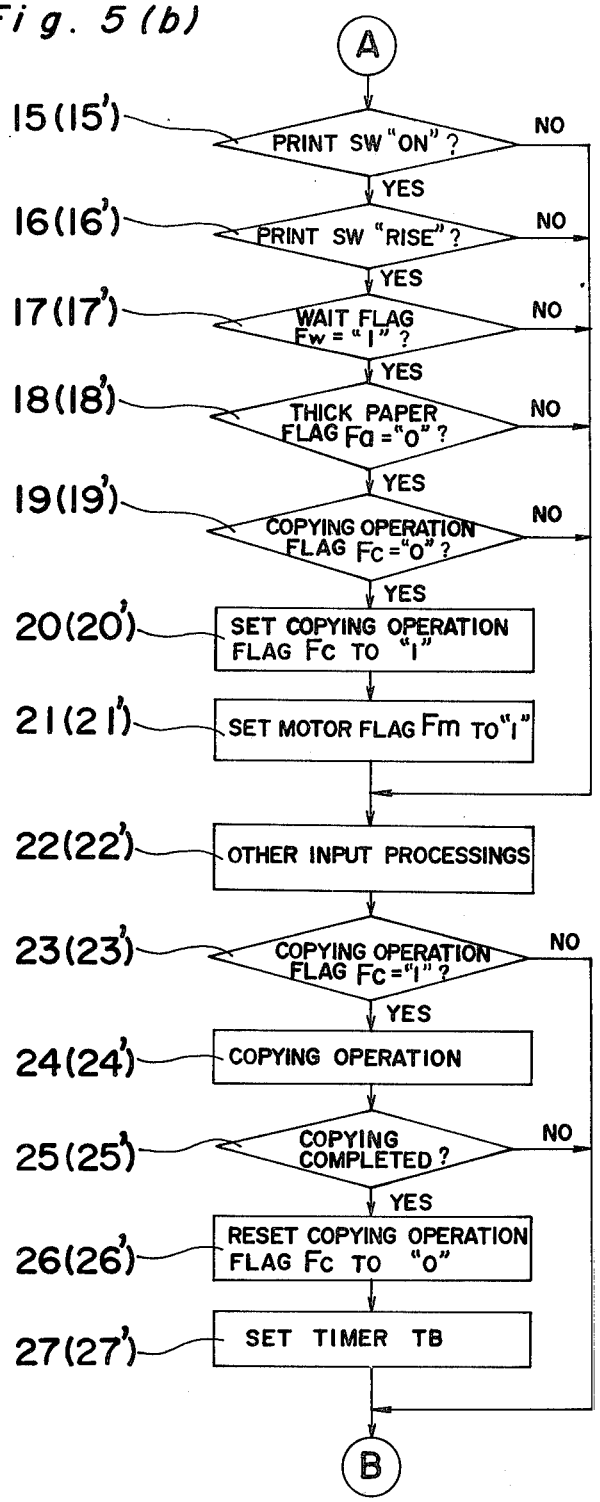
Figure 5C:
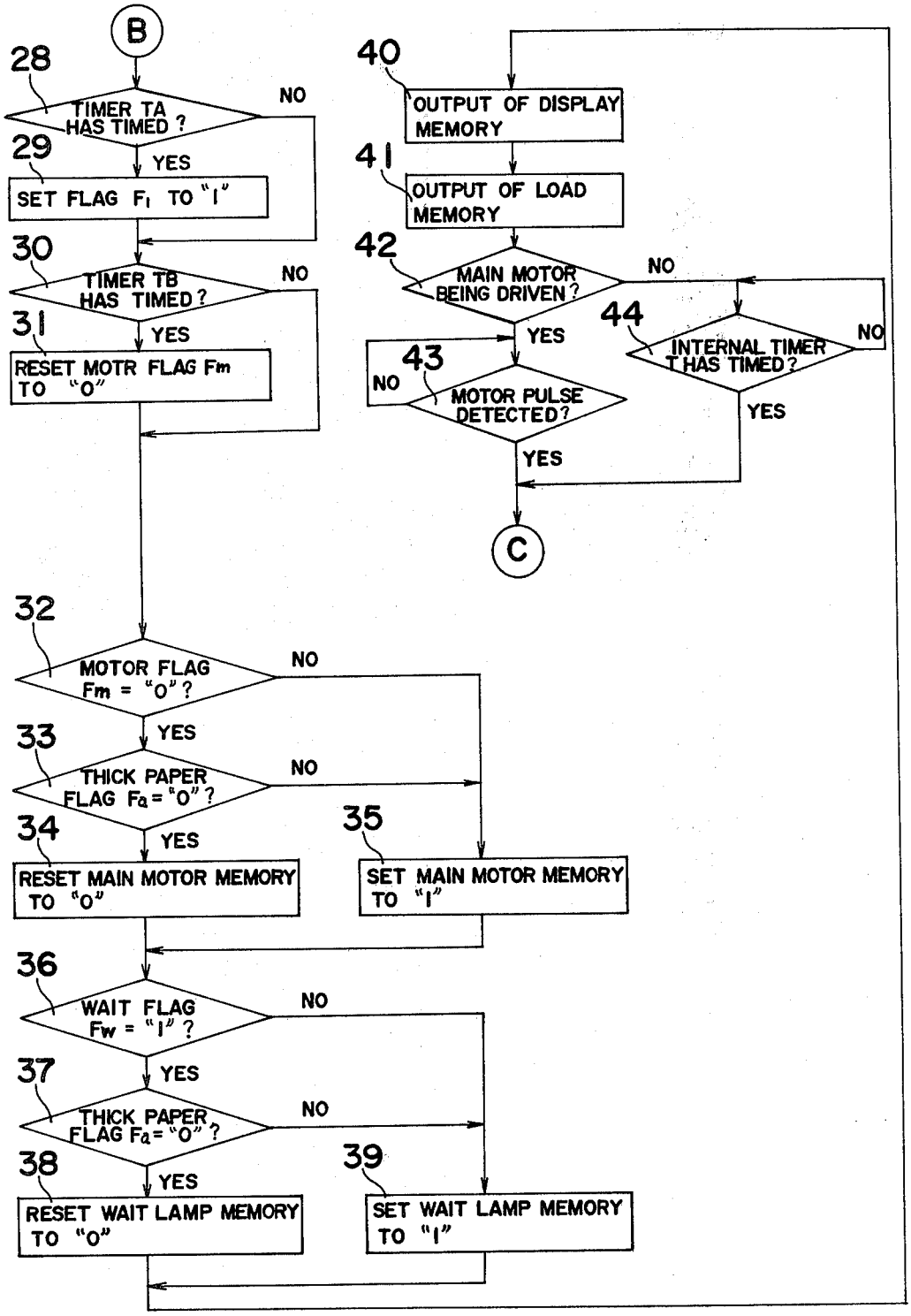

Referring to FIG. 5(*a*), after the power source has been turned on, all the flags F and a memory for the main motor 7 in the random access memory RAM are set to "0" and other memories are also set to their respective initial states at a step 1. Namely, initial states of the copying apparatus, etc. are set at the step 1.

Then, at a step 2, the internal timer T of the microcomputer 10 is set. A predetermined time period measured by the internal timer T, on the order of, for example, 10 mm sec., determines a time period during which one routine of the microcomputer 10 is executed.

If it is found at a step 3 by the thermistor 3 through the temperature control circuit 11 that the surface temperature of the heating roller 1 has reached the set temperature of 156° C., a wait flag Fw is set to "1" at a step 4. In the case of "NO" at the step 3, a step 8 follows. The wait flag Fw which is a decision flag for turning off the wait lamp 6 when the surface temperature of the heating roller 1 has reached the set temperature indicates "1" and "0" when the wait lamp 6 is turned off and on, respectively.

Then, if it is found at a step 5 that a flag F1 is "1", the flag F1 is set to "0" at a step 6 and a thick paper flag Fa is set to "0" at a step 7 followed by the step 8. In the case of "NO" at the step 5, the step 8 follows. The flag F1 which is set to "0" and "1" when a timer TA to be described later is performing its timing operation and after it has completed its timing operation, respectively, is a decision flag for the operation of the timer TA. Meanwhile, the thick paper flag Fa is set to "1" for 30 sec. after the thick paper copying switch has been turned on, and until the surface temperature of the heating roller 1 reaches the set temperature in the case where the surface temperature of the heating roller 1 has not yet reached the preset temperature after 30 sec. The thick paper flag Fa is set to "0" during a time period except for the above-described durations.

At the step 8, a decision is made as to whether or not the thick paper copying switch has been turned on. In the case of "NO" at the step 8, a step 15 in FIG. 5(*b*) follows. In the case of "YES" at the step 8, a decision is made at a step 9 as to rise of a signal generated by the thick paper copying switch so as to decide whether the thick paper copying switch has been turned on during the routine executed at the time of the decision or during the previous routine. If it is found at the step 9 that the thick paper copying switch has been turned on during the routine executed at the time of the decision, a decision is made as to whether or not the wait flag Fw is "1" at a step 10. In the case of "NO" at the step 9, the step 15 follows. In the case of "NO" at the step 10, the step 15 follows. In the case of "YES" at the step 10, a decision is made as to whether or not the thick paper flag Fa is "0" at a step 11. In the case of "NO" at the step 11, the step 15 follows. In the case of "YES" at the step 11, a decision is made as to whether or not a copying operation flag Fc is "0" at a step 12. The copying operation flag Fc is set to "1" and "0" when a copying operation is started upon turning on of the print switch and when the copying operation has been completed, respectively.

In the case of "NO" at the step 12, namely when the copying operation is being performed, the step 15 follows. In the case of "YES" at the step 12, the thick paper flag Fa is set to "1" at a step 13 and the timer TA is set at a step 14 followed by the step 15. The timer TA measures a predetermined time period of 30 sec.

Referring to FIG. 5(*b*), a decision is made as to whether or not the print switch has been turned on at the step 15. In the case of "YES" at the step 15, a decision is made at a step 16 as to rise of a signal generated by the print switch so as to decide whether the print switch has been turned on during the routine executed at the time of the decision or during the previous routine. In the case of "YES" at the step 16, a decision is made as to whether or not the wait flag Fw is "1" at a step 17.

In the case of "YES" at the step 17, a decision is made as to whether or not the thick paper flag Fa is "0" at a step 18. In the case of "YES" at the step 18, a decision is made as to whether or not the copying operation flag Fc is "0" at a step 19. In the case of "YES" at the step 19, the copying operation flag Fc is set to "1" at a step 20 and a motor flag Fm is set to "1" at a step 21 followed by a step 22.

In the case of "NO" at any one of the steps 15 to 19, the step 22 follows. It should be noted that the motor flag Fm is set to "1" until a timer TB to be described later has measured a predetermined time period after turning on of the print switch and is set to "0" during a time period except for the above-described duration.

At the step 22, receipt and processing of various inputs related to the copying operation are performed. Then, a decision is made at a step 23 as to whether or not the copying operation flag Fc is 1. In the case of "NO" at the step 23, a step 28 in FIG. 5(*c*) follows. In the case of "YES" at the step 23, the copying operation is performed at a step 24 and a decision is made at a step 25 as to whether or not the copying operation is completed. In the case of "NO" at the step 25, the step 28 follows. In the case of "YES" at the step 25, the copying operation flag Fc is reset to "0" at a step 26 and a timer TB is set at a step 27 followed by the step 28. The timer TB is an auto-shut timer for resetting the motor flag Fm to "0" upon lapse of a predetermined time period after completion of the copying operation.

Referring to FIG. 5(*c*), a decision is made at a step 28 as to whether or not the timer TA has measured the predetermined time period. In the case of "NO" at the step 28, a step 30 follows. In the case of "YES" at the step 28, the flag F1 is set to "1" at a step 29 followed by the step 30. A decision is made at the step 30 as to whether or not the auto-shut timer TB has measured the predetermined time period. In the case of "NO" at the step 30, a step 32 follows. In the case of "YES" at the step 30, the motor flag Fm is reset to "0" at a step 31 followed by the step 32.

If it is found at the step 32 that the motor flag Fm is "0", a decision is made at a step 33 as to whether or not the thick paper flag Fa is "0". In the case of "YES" at the step 33, a main motor memory in the random access memory RAM is reset to "0" at a step 34 followed by a step 36. In the case of "NO" at either one of the steps 32 and 33, the main motor memory is set to "1" at a step 35 followed by the step 36.

If it is found at the step 36 that the wait flag Fw is 1, a decision is made at a step 37 as to whether or not the thick paper flag Fa is "0". In the case of "YES" at the step 37, a wait lamp memory in the random access memory RAM is reset to "0" at a step 38 followed by a step 40. In the case of "NO" at either one of the steps 36 and 37, the wait lamp memory is set to "1" at a step 39 followed by the step 40.

At the step 40, output of data stored in memories in the random access memory RAM, which memories are related to display devices such as a lamp, etc., is performed. Accordingly, output of data stored in the above-described wait lamp memory is also performed at the step 40 so as to turn on and off the wait lamp when the output data are "1" and "0", respectively. Then, at a step 41, output of data stored in memories in the random access memory RAM, which memories are related to loading devices such as the main motor 7, etc., is performed. Accordingly, output of data stored in the above-described main motor memory is also performed at the step 41 so as to start and stop rotation of the main motor 7, when the output data are "1" and "0", respectively.

Then, a decision is made at a step 42 as to whether or not the main motor 7 is being driven. In the case of "YES" at the step 42, a decision is made as to whether or not a motor pulse from the motor pulse generating circuit 14 shown in FIG. 3 has been detected. In the case of "YES" at the step 43, the step 2 follows to loop the program. In the case of "NO" at the step 42, a decision is made at a step 44 as to whether or not the internal timer T which has been set at the step 2 has measured the predetermined time period. In the case of "YES" at the step 44, the step 2 follows. Namely, a time period for executing one routine of the microcomputer 10 is determined by a duration of the motor pulse and by the predetermined time period measured by the internal timer T when the main motor 7 is being driven and is not being driven, respectively.

Hereinbelow, the processing sequences will be described in connection with actual operations of the heat roller fixing device according to the present invention.

Firstly, when the power source has been turned on, the thermistor 3 detects the surface temperature of the heating roller 1 so that the heater 2 may be turned on by the temperature control circuit 11 through the heater control circuit 12 since the surface of the heating roller 1 cools down. At the same time, all the flags F, etc. are set to their respective initial states at the step 1. Then, the internal timer T is set at the step 2 and a decision is made at the step 3 as to whether or not the surface temperature of the heating roller 1 has reached the set temperature. Since at the step 3, a decision of "NO" is made due to the low surface temperature of the heating roller 1, the step 8 follows so as to decide whether or not the thick paper copying switch has been turned on. However, since the thick paper copying switch is in the off position, a decision of "NO" is made at the step 8 and thus, the step 15 follows so as to decide whether or not the print switch has been turned on. Since the print switch has not ben turned on, a decision of "NO" is made at the step 15 and thus, the steps 22 and 23 follow. At the step 23, a decision is made as to whether or not the copying operation flag Fc is "1". Since the copying operation flag Fc has been also set to "0" at the step 1, the step 23 is followed by the step 28 for deciding whether or not the timer TA has measured the predetermined time period. Since the step 14 is not executed in this routine, a decision of "NO" is made at the step 28 and thus, the step 30 follows so as to decide whether or not the timer TB has measured the predetermined time period. Since the step 27 is not executed in this routine, a decision of "NO" is made at the step 30 and thus, the step 32 follows so as to decide whether or not the motor flag Fm is "0". Since the motor flag Fm has been set to "0" at the step 1, a decision of "YES" is made at the step 32 and thus, the step 33 follows so as to decide whether or not the thick paper flag Fa is "0". Since the thick paper flag Fa has been also set to "0" at the step 1, a decision of "YES" is made at the step 33 and thus, the step 34 follows so as to reset the main motor memory in the random access memory RAM to "0".

Then, at the step 36, a decision is made as to whether or not the wait flag Fw is "1". Since the wait flag Fw has been set to "0" at the step 1, a decision of "NO" is made at the step 36 and thus, the step 39 follows so as to set the wait lamp memory in the random access memory RAM to "1". Then, at the step 40, output of "1" stored in the wait lamp memory is performed so as to turn on the wait lamp 6. Output of data stored in memories in the random access memory RAM, which memories are related to loading devices such as the main motor 7, etc., is performed at the step 41 followed by the step 42 for deciding whether or not the main motor 7 is being driven. Since the main motor 7 is not being driven at this moment, a decision of "NO" is made at the step 42 and thus, the step 44 follows so as to decide whether or not the internal timer T has measured the predetermined time period. The step 44 is repeated until the internal timer T has measured the predetermined time period. When the internal timer T has measured the predetermined time period, one routine of the microcomputer 10 is completed so that the step 2 may follow.

The above-described routine is repeated until the surface temperature of the heating roller 1 reaches the set temperature. Meanwhile, even if a trial of turning on of the thick paper copying switch and print switch is made during the above-described routine, turning on of the switches is substantially prevented because the steps 10 and 17 lead to the steps 15 and 23, respectively.

When the surface temperature of the heating roller 1 has reached the set temperature, the heater 2 is turned off in response to detection by the thermistor 3 through the temperature control circuit 11 and heater control circuit 12. Since the detection signal is supplied to the input port Io of the microcomputer 10, a decision of "YES" is made at the step 3 and thus, the wait flat Fw is set to "1" at the step 4 followed by the step 5 for deciding whether or not the flag F1 is "1". Since the flag F1 is maintained at "0" to which the flag F1 has been set at the step 1, a decision of "NO" is made at the step 5 and thus, the step 8 follows. The step 8 leads to the steps 15, 22 and 23. Since the copying operation flag Fc is maintained at "0" to which the copying operation flag Fc has been set at the step 1, a decision of "NO" is made at the step 23 and thus, the steps 28, 30, 32, 33, 34 and 36 follow.

Since the wait flag Fw has been set to "1" at the step 4, a decision of "YES" is made at the step 36 and thus, the steps 37 and 38 follow. The wait lamp memory in the random access memory RAM is reset to "0" at the step 38 followed by the step 40. At the step 40, the wait lamp is turned off by data at the step 38 so as to display termination of the waiting time, i.e. a state enabling copying. Then, the steps 41, 42,44 and 2 follow so as to repeat the above-described routine.

When the print switch is turned on so as to perform copying on a plain paper in the stand-by state enabling copying in response to turning off of the wait lamp as described above, the signal is supplied to the input port $I_3$ of the microcomputer 10, so that a decision of "YES" is made at the step 15 and thus, the steps 17 to 25, 28, 32, and 35 follow. At the step 35, the main motor memory in the random access memory RAM is set to "1" and then, the steps 36 to 38, 40 and 41 follow. At the step 41, the main motor 7 is driven and then, the steps 42 and 43 follow so as to perform the copying operation. The step 43 leads to the steps 2 to 5, 8 and 15, but from the second routine after turning on of the print switch, a decision of "NO" is made at the step 16 and thus, the step 16 is followed by the step 22. The above-described routine is repeated until completion of the copying operation. However, even if a trial of turning on of the thick paper copying switch is made during the copying operation, a signal for turning on the thick paper copying switch is prevented from being received by the microcomputer 10 because the step 12 leads to the step 15.

Upon completion of the copying operation, a decision of "YES" is made at the step 25. Then, the copying operation flag Fc is reset to "0" at the step 26 and the timer TB is set at the step 27 followed by the steps 28 and 30. Since the timer TB has not measured the predetermined time period in this routine, a decision of "NO" is made at the step 30 and thus, the steps 32 and 35 follow. From the next routine, the step 23 leads to the step 28. Then, when the timer TB has measured the predetermined time period, a decision of "YES" is made at the step 30, so that the motor flag Fm is reset to "0" at the step 31 and thus, the steps 32, 33, and 34 follow. At the step 34, the main motor memory in the random access memory RAM is reset to "0" and thus, the steps 36, 37, 38, 40 and 41 follow. At the step 41, the main motor 7 is turned off and thus, the copying on the plain paper is completed, whereby the processing sequence is returned to the routine in the stand-by state.

Then, when the thick paper copying switch is turned on, a decision of "YES" is made at the step 8 in the course of the routine in the stand-by state and thus, the steps 9, 10, 11, 12 and 13 follow. The thick paper flag Fa is set to "1" at the step 13 and the timer TA measuring the predetermined time period of 30 sec. is set at the step 14 followed by the steps 15, 22, 23 and 28. Since the timer TA has not measured the predetermined time period in the routine, a decision of "NO" is made at the step 28 and thus, the step 32 follows. Since the motor flag Fm is "0" in this routine, the step 33 follows. Since the thick paper flag Fa has been set to "1" at the step 13, a decision of "NO" is made at the step 33 and thus, the step 35 for setting the main motor memory to "1" and the step 36 follow. Since the wait flag Fw is "0", a decision of "NO" is made at the step 36 and thus, the step 39 for setting the wait lamp memory in the random access memory RAM to "1", the step 40 for turning on the wait lamp, and the step 41 for turning on the main motor 7 follow. Then, the steps 42 and 43 follow. When the main motor 7 starts rotating, heat of the surface of the heating roller 1 is absorbed by the pressure roller 4, so that the surface temperature of the heating roller 1 drops and thus, the step 3 leads to the step 8 by skipping the steps 4 to 7. Then, upon the lapse of 30 sec. after the thick paper copying switch has been turned on, a decision of "YES" is made at the step 28 and thus, the step 29 follows for setting the flag F1 is to "1".

When the surface temperature of the heating roller 1 reaches the set temperature before the timer TA has measured the predetermined time period of 30 sec., a decision of "YES" is made at the step 3 and thus, the step 4 for setting the wait flag Fw to "1" and the step 5 follow. However, since the flag F1 is maintained at "0" in this routine, a decision of "NO" is made at the step 5 and thus, the step 8 follows. Namely, even if the surface temperature of the heating roller 1 reaches the set temperature in less than 30 sec., the main motor 7 and the wait lamp 6 are maintained at their "ON" state and are turned off upon the lapse of 30 sec.

Meanwhile, in the case where the surface temperature of the heating roller 1 does not reach the set temperature after the lapse of 30 sec., since the thick paper flag Fa is maintained at "1" even if the flag F1 is set to "1" at the step 29, the main motor 7 and the wait lamp 6 are maintained at their "ON" state. When the surface temperature of the heating roller 1 has reached the set temperature, the flag F1 and thick paper flag Fa are set to "0" at the steps 6 and 7, respectively and the main motor 7 and wait lamp 6 are turned off.

Meanwhile, even if a trial of turning on of the print switch is made in the above described state, the signal is not received by the microcomputer 10 due to a decision made at the step 18.

When the heating roller 1 and pressure roller 4 are rotated in response to turning on of the thick paper copying switch, heat of the surface of the heating roller 1 is absorbed by the pressure roller 4, resulting in drop of the surface temperature of the heating roller 1. Meanwhile, the surface temperature of the pressure roller 4 rises sharply from approximately 40° C. in the case of intermittent copying opera-tions. Then, when the surface temperature of the heating roller 1 has reached the set temperature upon the lapse of 30 sec., power supply to the heater 2 is shut off by the temperature control circuit 11 and heater control circuit 12 independently of the flow charts shown in FIGS. 5(*a*) to 5(*c*). At this time, the pressure roller 4 has been sufficiently heated. Then, even if a copying operation on the thick paper is performed by turning on the print switch as in the case of the above-described copying operation on the plain paper, since the heating roller 1 and pressure roller 4 have been sufficiently heated, proper fixing of a toner image on the thick paper can be accomplished without lack of quantity of heat for fusion of the toner image.

Meanwhile, even if a copying operation on the plain paper is performed immediately after the wait lamp 6 and main motor 7 have been turned off upon the lapse of 30 sec. after turning on of the thick paper copying switch, proper fixing can be accomplished with elimination of high temperature offset, etc. since the set temperature of the heating roller 1 for the plain paper is the same as that for the thick paper.

Meanwhile, it is needless to say that the predetermined time period measured by the timer TA and the set temperature of the heating roller 1 can be changed variously.

Furthermore, when a copying operation on the thick paper is performed, the copying operation can be started in accordance with detection by a manual paper feeding switch without the use of the print switch.

However, such a problem as will be described below arises in this embodiment. When the surface temperature of the heating roller 1 is restored to the set temperature of 156° C. upon the lapse of 30 sec. after turning on of the thick paper copying switch, waiting for the copying operation on the thick paper is terminated. Namely, when the surface temperature of the pressure roller 4 has reached approximately 80° C., its drive is stopped. Then, since the pressure roller 4 is kept at a stop during a duration from completion of the waiting to turning on of the print switch (starting of the copying operation), the surface temperature of the pressure roller 4 drops gradually from 80° C. as shown in FIG. 2. Accordingly, when the surface temperature of the pressure roller 4 drops down to a temperature which prevents a proper copying operation on the thick paper, for example 60° C., it becomes necessary to turn on the thick paper copying switch again. It is to be noted that, in this embodiment, the copying operation on the thick paper can be performed when the surface temperature of the pressure roller 4 is approximately 60° C. or more, but improper fixing results when the surface temperature is less than 60° C. Accordingly, in this embodiment, it is so arranged that the thick paper copying switch can be actuated, i.e. actuation thereof is not prohibited during a duration from completion of the waiting to turning on of the print switch as described earlier. Therefore, this embodiment is encountered by such a problem that, in the case where an operator of the copying apparatus turns on the thick paper copying switch inadvertently after completion of the waiting for copying on the thick paper, he must wait for another 30 sec. in spite of operable conditions of the copying on the thick paper before starting the copying operation on the thick paper.

Figure 6:
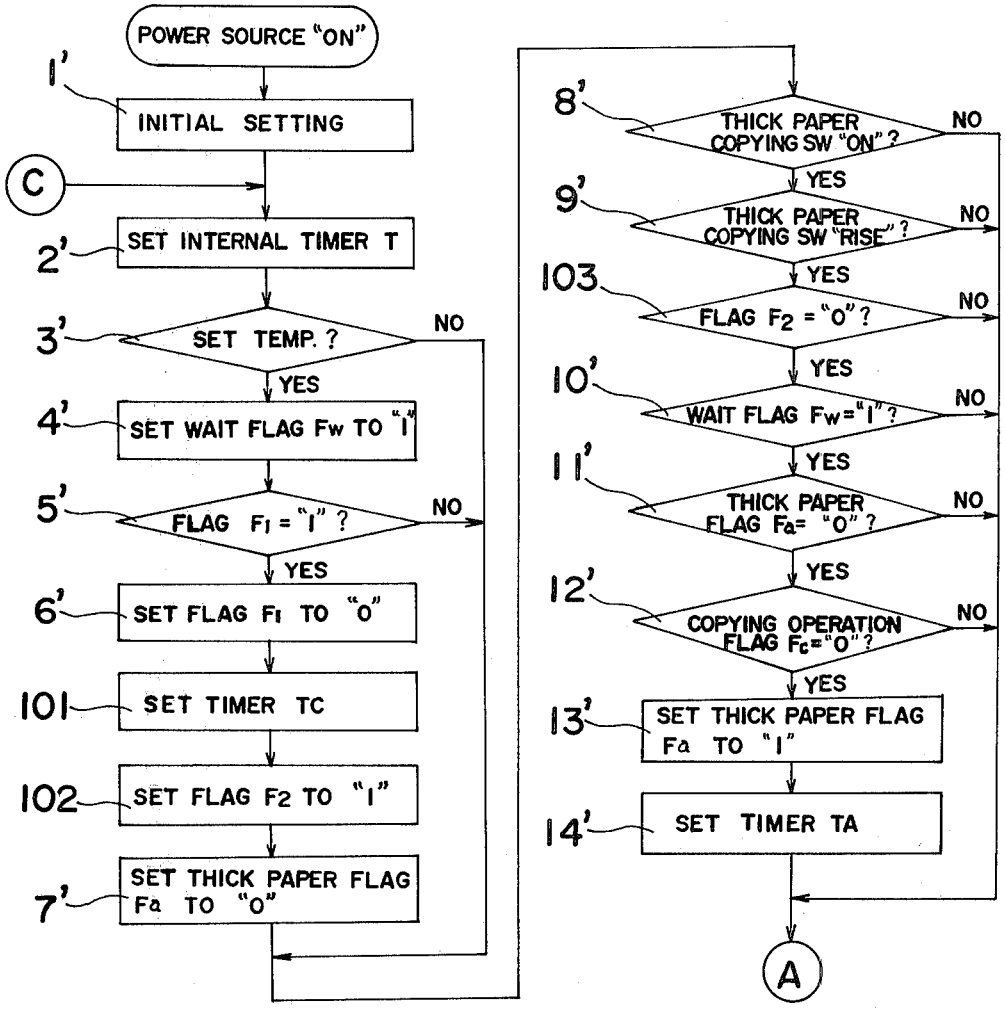
Figure 6B:
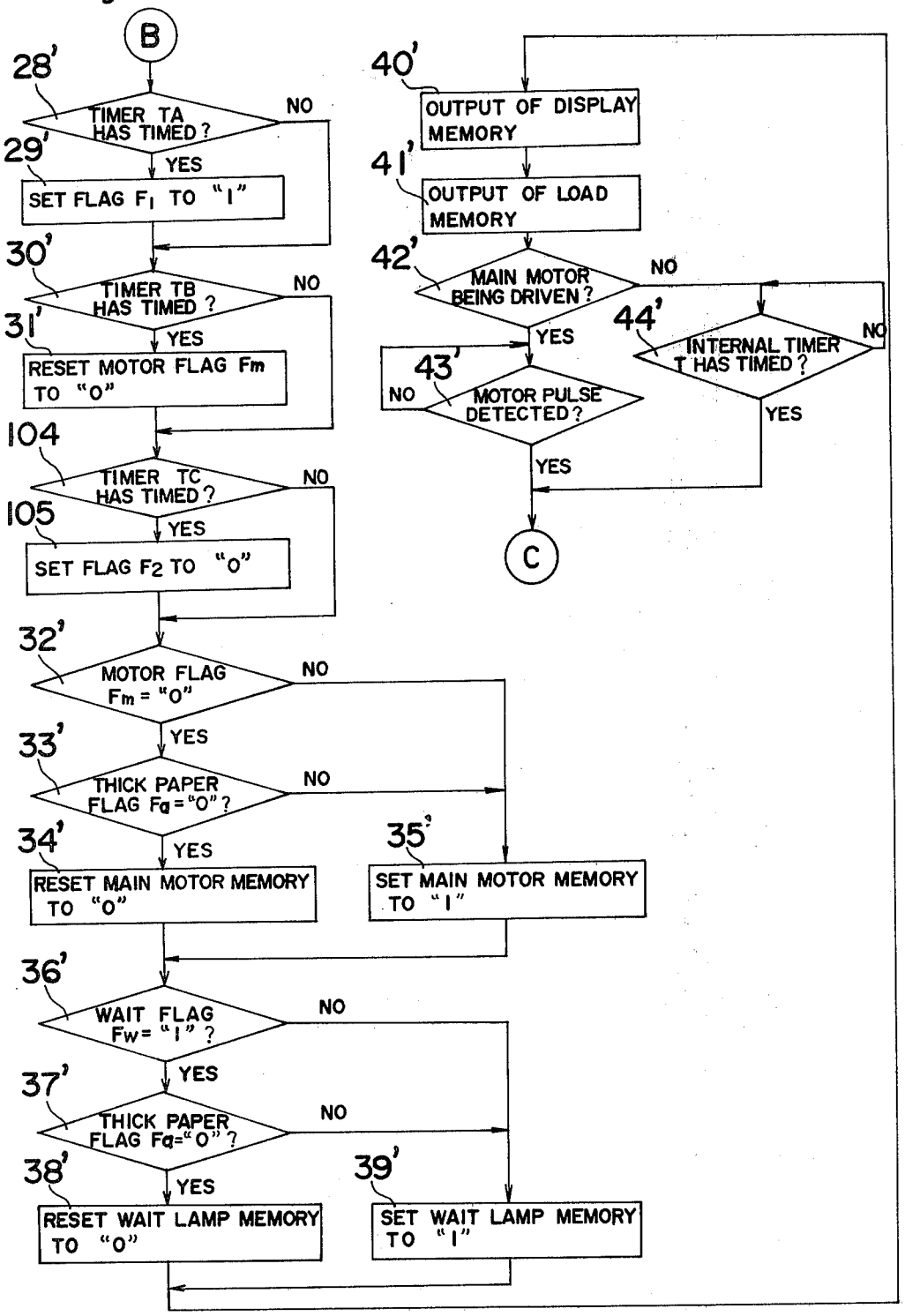
Figure 7:
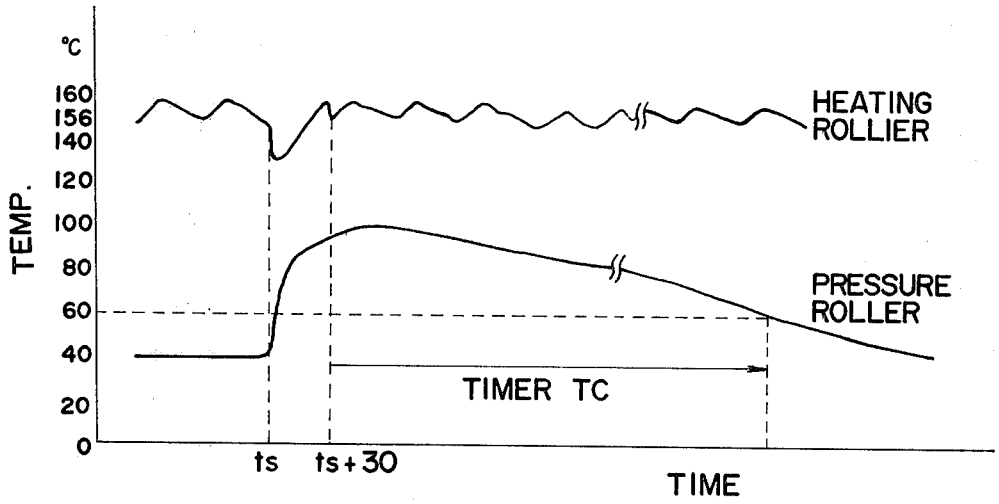
FIG. 7 is a graph similar to FIG. 2, particularly showing a modification thereof in accordance with flow charts shown in FIGS. 6(*a*) and 6(*b*).

In order to solve the above-described problem, a modification of this embodiment will be described in accordance with flow charts in FIGS. 6(*a*), 5(*b*), and 6(*b*), with reference to a graph in FIG. 7, hereinbelow. Processing sequences of the modification are composed of steps 1' to 6', 101, 102, 7' to 9', 103, 10' to 14' in FIG. 6(*a*), steps 15' to 27' in parentheses in FIG. 5(*b*), and steps 28' to 31', 104, 105, 32' to 44' in FIG. 6(*b*). Since the steps 1' to 44' are exactly the same as the steps 1 to 44, respectively in FIGS. 5(*a*) to 5(*c*), processing sequences of the modification are formed only by adding underlined five steps, i.e. steps 101 to 105, to the steps 1 to 44. Accordingly, only processing sequences related to the added steps 101 to 105 will be described hereinbelow. Referring to FIG. 6(*a*), at the step 101, a timer TC is set. The timer TC measures a predetermined time period after completion of the waiting as shown in FIG. 7. At the step 102, a flag F2 is set to "1". At the step 103, a decision is made as to whether or not the flag F2 is "0". In the case of "NO" and "YES" at the step 103, the steps 15' and 10' follow, respectively.

Referring to FIG. 6(*b*), at the step 104, a decision is made as to whether or not the timer TC which was set at the step 101 has measured the predetermined time period. In the case of "NO" and "YES" at the step 104, the steps 32' and 105 follow, respectively. At the step 105, the flag F2 is set to "0".

When the thick paper copying switch is turned on in the stand-by state enabling a copying operation on the plain paper after the surface temperature of the heating roller has reached the set temperature in response to turning on of the power source, a decision of "YES" is made at the step 8' and thus, the steps 9', 103, 10', 11', 12' and 13' follow. The thick paper flag Fa is set to "1" at the step 13' and then, the timer TA measuring the predetermined time period of 30 sec. is set at the step 14'. When the surface temperature of the heating roller 1 has reached the set temperature at this moment, a decision of "YES" is made at the step 3' and thus, the step 4' for setting the wait flag Fw to "1" and the step 5' follow. Meanwhile, when the timer TA has measured the predetermined time period of 30 sec., a decision of "YES" is made at the step 28' and thus, the step 29' for setting the flag F1 to "1" follows. Accordingly, after a decision of "YES" has been made at the step 5' and the flag F1 has been set to "0" at the step 6', the timer TC is set at the step 101, the flag F2 is set to "1" at the step 102 and further, the thick paper copying flag Fa is set to "0" at the step 7' so as to turn off the main motor 7 and wait lamp 6.

When the thick paper copying switch is turned on in this state, a decision of "YES" is made at the step 8'. Since a decision of "YES" is made at the step 9', the step 103 follows. Since the flag F2 has been set to "1" at the step 102, a decision of "NO" is made at the step 103 and thus, the step 15, follows by skipping the step 14' for setting the timer TA measuring the predetermined time period of 30 sec.

Accordingly, the timer TA is not reset. When the timer TC has measured the predetermined time period subsequently, a decision of "YES" is made at the step 104 and the flag F2 is set to "0" at the step 105. Therefore, when the thick paper copying switch is turned on in this state, a decision of "YES" is made at the step 103 and thus, it becomes possible to set the timer TA.

Accordingly, in the above-described modified embodiment, even if the operator turns on the thick paper copying switch inadvertently during the predetermined time period measured by the timer TC after completion of the waiting for copying on the thick paper, the timer TA measuring the predetermined time period of 30 sec. is not set and thus, he need not wait for another 30 sec. before starting the copying operation on thick paper.

Meanwhile, although a heat roller fixing device according to the present invention is applied to a copying apparatus in the above-described embodiment and its modification, it is needless to say that it is applicable to a facsimile, a printer, etc.

As is clear from the foregoing description, a heat roller fixing device according to the present invention comprises a changeover means to be selectively changed over in accordance with thickness of a copy paper, and a control circuit for causing a heating roller and a pressure roller in pressure contact with the heating roller to rotate when the changeover means has been changed over to a thick paper and for stopping the rotation of the heating roller and pressure roller when the surface of the heating roller has reached a predetermined temperature.

Accordingly, in accordance with the present invention, in the case of copying on a thick paper, a pressure roller is preheated by heat of a heating roller, so that the thick paper is efficiently heated for fixing a toner image thereon by setting the heating roller itself at the same temperature as that for copying on a plain paper and thus, an additional temperature setting circuit or a temperature detecting element measurable over a wide range of temperature provided in conventional heat roller fixing devices is not required, whereby a production cost thereof has been reduced remarkably. Furthermore, since the set temperature of the heating roller for the plain paper is the same as that for the thick paper as described above, the toner image can be fixed on the plain paper immediately after completion of a copying operation on the thick paper, without the need for waiting therefor.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A heat roller fixing device comprising:

a heating roller which is provided with a heating means;

a pressure roller which is held in pressure contact with said heating roller;

a temperature detecting means for detecting surface temperature of said heating roller;

a temperature control means for controlling said surface temperature of said heating roller so as to cause said surface temperature to be equal to a predetermined temperature by respectively turning said heating means on and off before and when said surface temperature of said heating roller, as detected by said temperature detecting means, has reached said predetermined temperature;

a drive means for rotating said heating roller and said pressure roller when said heating roller is being held in pressure contact with said pressure roller;

a changeover means which is selectively changed over to a thick copy mode in accordance with a thickness of a copy paper;

a first means for turning said drive means on when said changeover means has been changed over to a thick copy paper mode; and a second means for turning said drive means off when said surface temperature of said heating roller, as detected by said temperature detecting means, has reached said predetermined temperature and said changeover means has been changed over to said thick copy paper mode;

wherein said heating roller and said pressure roller are rotated in response to said drive means being turned on so as to preheat said pressure roller through absorption of heat from said heating roller by said pressure roller, and said heating means is kept turned on by said temperature control means until said surface temperature of said heating roller, having been below said predetermined temperature is restored to said predetermined temperature, whereby it is possible for a copying apparatus including said fixing device to perform a copying operation on thick copy paper.

2. A heat roller fixing device as claimed in claim 1, further comprising a third means for forcibly maintaining said drive means turned on for a first predetermined time period irrespective of said surface temperature of said heating roller when said changeover means has been changed over to said thick copy paper mode.

3. A heat roller fixing device as claimed in claim 1 or 2, further including a fourth means for prohibiting said drive means from being turned on, for a second predetermined time period, by said changeover of said changeover means to said thick copy paper mode when said changeover means is changed over from said thick copy mode after said drive means has been turned off when said changeover means had been changed over to said thick copy paper mode.

* * * * *